US009583038B2

(12) United States Patent
Li

(10) Patent No.: US 9,583,038 B2
(45) Date of Patent: Feb. 28, 2017

(54) METHOD AND SYSTEM FOR WRITING ADDRESS CODES INTO LED DISPLAY DEVICES

(71) Applicant: Shenzhen Sunmoon Microelectronics Co., Ltd., Guangdong (CN)

(72) Inventor: Zhaohua Li, Guangdong (CN)

(73) Assignee: Shenzhen Sunmoon Microelectronics Co., Ltd. (CN)

( * ) Notice: Subject to any disclaimer, the term of this patent is extended or adjusted under 35 U.S.C. 154(b) by 249 days.

(21) Appl. No.: 14/304,568

(22) PCT Filed: Dec. 30, 2013

(86) PCT No.: PCT/CN2013/090870
§ 371 (c)(1),
(2) Date: Jun. 13, 2014

(87) PCT Pub. No.: WO2014/180155
PCT Pub. Date: Nov. 13, 2014

(65) Prior Publication Data

US 2015/0228220 A1 Aug. 13, 2015

(30) Foreign Application Priority Data

May 9, 2013 (CN) ..... 2013 1 0169176

(51) Int. Cl.
*G09G 3/32* (2016.01)
*G09G 3/20* (2006.01)
(Continued)

(52) U.S. Cl.
CPC ..... *G09G 3/32* (2013.01); *G09G 3/2003* (2013.01); *G09G 3/2085* (2013.01);
(Continued)

(58) Field of Classification Search
None
See application file for complete search history.

(56) References Cited

U.S. PATENT DOCUMENTS 6,031,343 A * 2/2000 Recknagel ..... A63D 1/08 315/292
2007/0188427 A1* 8/2007 Lys ..... H05B 33/0815 345/82
(Continued)

FOREIGN PATENT DOCUMENTS

CN 1684567 10/2005
CN 1804962 7/2006
(Continued)

*Primary Examiner* — Carolyn R Edwards
*Assistant Examiner* — Krishna Neupane
(74) *Attorney, Agent, or Firm* — Ross Barnes LLP; Monty L. Ross; Robin L. Barnes

(57) ABSTRACT

The present invention relates to data coding control field, and provides a method and system for writing address codes into LED display devices. According to the embodiments of the present invention, when all the LED display devices in parallel in the display module are in series with the same number of LED display devices, the address code is written into the primary LED display device and LED display devices in series with the primary LED display device respectively according to the preset address code and the preset number in the series connection, and the address code is written into one or more LED display devices connected in parallel with the primary LED display device and LED display devices connected in series with each of the one or more LED display devices in parallel with the primary LED display device successively in an address code ascending manner. Thus address codes are written into the LED display devices at a time, it is not necessary to write address codes into the LED display devices one by one, therefore, the efficiency of writing codes is improved.

12 Claims, 6 Drawing Sheets

(51) Int. Cl.
*H05B 33/08* (2006.01)
*H05B 37/02* (2006.01)

(52) U.S. Cl.
CPC ..... *H05B 33/0842* (2013.01); *H05B 37/0254* (2013.01); *G09G 2320/0613* (2013.01); *G09G 2320/0626* (2013.01); *G09G 2320/08* (2013.01)

(56) References Cited

U.S. PATENT DOCUMENTS

| | | | | |
|---|---|---|---|---|
| 2008/0088258 | A1* | 4/2008 | Ng ..... | H05B 33/0818 315/294 |
| 2011/0057866 | A1 | 3/2011 | Konicek | |

FOREIGN PATENT DOCUMENTS

| | | |
|---|---|---|
| CN | 201919203 | 8/2011 |
| CN | 102867482 | 1/2013 |
| CN | 103268751 | 8/2013 |

* cited by examiner

METHOD AND SYSTEM FOR WRITING ADDRESS CODES INTO LED DISPLAY DEVICES

BACKGROUND OF THE INVENTION

1. Technical Field

The present invention relates to data coding control field, and more particularly, to a method and system for writing address codes into LED display devices.

2. Description of Related Art

With the widespread use of an LED display device in various occasions and fields, users focus on the growing demands for reliability of the LED display device, one important assurance for the reliability is an architecture pattern of the LED display device. Due to shortcomings of the serial architecture pattern, in most cases a parallel architecture pattern is used in LED display devices in the prior art so as to form a complete LED display or decorating module, i.e. all LED display devices in parallel share the same signal bus. In order to achieve desired display effect, every LED display device should have its address code to capture the corresponding data stream from the signal bus thereby displaying according to the captured data stream. Therefore, a plurality of LED display devices in parallel need an address coding during production or installation of the plurality of the LED display devices, thereafter, the plurality of the LED display devices can be put into use. According to a writing mode of the address code in the prior art, address codes are written into LED display devices one by one by a coder. Writing operation of the address codes can be completed, however, the operation is time-consuming and inefficient, therefore, it is inconvenient for writing codes in mass production of the LED device, which will affect the production efficiency and tooling test efficiency.

BRIEF SUMMARY OF THE INVENTION

The present invention aims at providing a method for writing address codes into LED display devices to overcome the shortcomings of poor efficiency of writing codes existing in the prior art, which are inconvenient for massively writing codes into LED display devices and further affect the production efficiency and tooling test efficiency.

The present invention is achieved by a method for writing address codes into LED display devices, the method includes:

generating a preset address code and a preset number in series connection according to user's settings; and writing an address code into an primary LED display device and the LED display devices in series with the primary LED display device respectively according to the preset address code and the preset number in the series connection when all the LED display devices in parallel in a display module are connected in series with the same number of LED display devices respectively, and writing the address code into one or more LED display devices connected in parallel with the primary LED display device and the LED display devices connected in series with each of the one or more LED display devices in parallel with the primary LED display device successively in an address code ascending manner according to the preset address code and the preset number in the series connection.

The writing method for the address codes further includes:

writing the address code into one of the LED display devices in parallel according to the preset address code when the numbers of the LED display devices in series with respective LED display devices in parallel in the display module are not exactly the same or are totally different, and writing the address code into the LED display devices in series with the one of LED display devices successively in an address code ascending manner at a time according to the preset address code and the preset number in the series connection, and then returning to the step of generating a preset address code and a preset number in the series connection according to user's settings.

The writing method for the address codes further includes:

driving an LED in the LED display device to emit light of a first prompt color, when the address codes are successfully written into the LED display devices in the LED display module.

The writing method for the address codes further includes:

driving an external display media connected to the LED display module to display the present address code when the address code is successfully written into the LED display device in the LED display module.

Another object of the embodiment of the present invention is to provide a system for writing address codes into LED display devices, the system includes:

a setting module, configured to generate a preset address code and a preset number in series connection according to user's settings; and a main control module, configured to write an address code into an primary LED display device and the LED display devices in series with the primary LED display device respectively according to the preset address code and the preset number in the series connection when all the LED display devices in parallel in a display module are connected in series with the same number of LED display devices respectively, and write the address code into one or more LED display devices connected in parallel with the primary LED display device and the LED display devices connected in series with each of the one or more LED display devices in parallel with the primary LED display device successively in an address code ascending manner according to the preset address code and the preset number in the series connection.

when the numbers of the LED display devices in series with respective LED display devices in parallel in the display module are not exactly the same or are totally different, the main control module writes the address code into one of LED display devices in parallel according to the preset address code, and writes the address code into the LED display devices in series with the one of LED display devices successively in an address code ascending manner at a time according to the preset address code and the preset number in the series connection, and then returns to the setting module.

The writing system for the address codes further includes:

a light prompt driving module disposed in the LED display device, configured to drive an LED in the LED display device to emit light of a first prompt color when the address codes are successfully written into the LED display devices in the LED display module.

The writing system for the address codes further includes:

a display driver module, configured to an external display media connected to the LED display module to display the present address code when the address code is successfully written into the LED display device in the LED display module.

According to the embodiments of the present invention, when all the LED display devices in parallel in the display module are connected in series with the same number of LED display devices, the address code is written into the primary LED display device and the LED display devices in series with the primary LED display device respectively according to the preset address code and the preset number in the series connection, and the address code is successively written into one or more LED display devices connected in parallel with the primary LED display device and the LED display devices connected in series with each of the one or more LED display devices in parallel with the primary LED display device in an address code ascending manner. Thus address codes are written into the LED display devices at a time, it is not necessary to write address codes into the LED display devices one by one, therefore, the efficiency of writing codes is improved, the shortcomings of poor efficiency of writing codes which is inconvenient for massively writing codes into LED display devices and further affect the production efficiency and tooling test efficiency are overcome.

DETAILED DESCRIPTION OF THE INVENTION

In order to make the objects, technical solutions and advantages of the invention clearer, the present invention will be further described hereafter with reference to the accompanied drawings and embodiments. It shall be understood that, the embodiments described herein are only intended to illustrate but not to limit the present invention.

According to the embodiments of the present invention, when all the LED display devices in parallel in the display module are connected in series with the same number of the LED display devices, the address code is written into the primary LED display device and the LED display devices in series with the primary LED display device respectively according to the preset address code and the preset number in the series connection, the address code is written into one or more LED display devices connected in parallel with the primary LED display device and the LED display devices connected in series with each of the one or more LED display devices in parallel with the primary LED display device successively in an address code ascending manner. Thus address codes are written into the LED display devices at a time, it is not necessary to write address codes into the LED display devices one by one; therefore, the efficiency of writing codes is improved.

Figure 1:
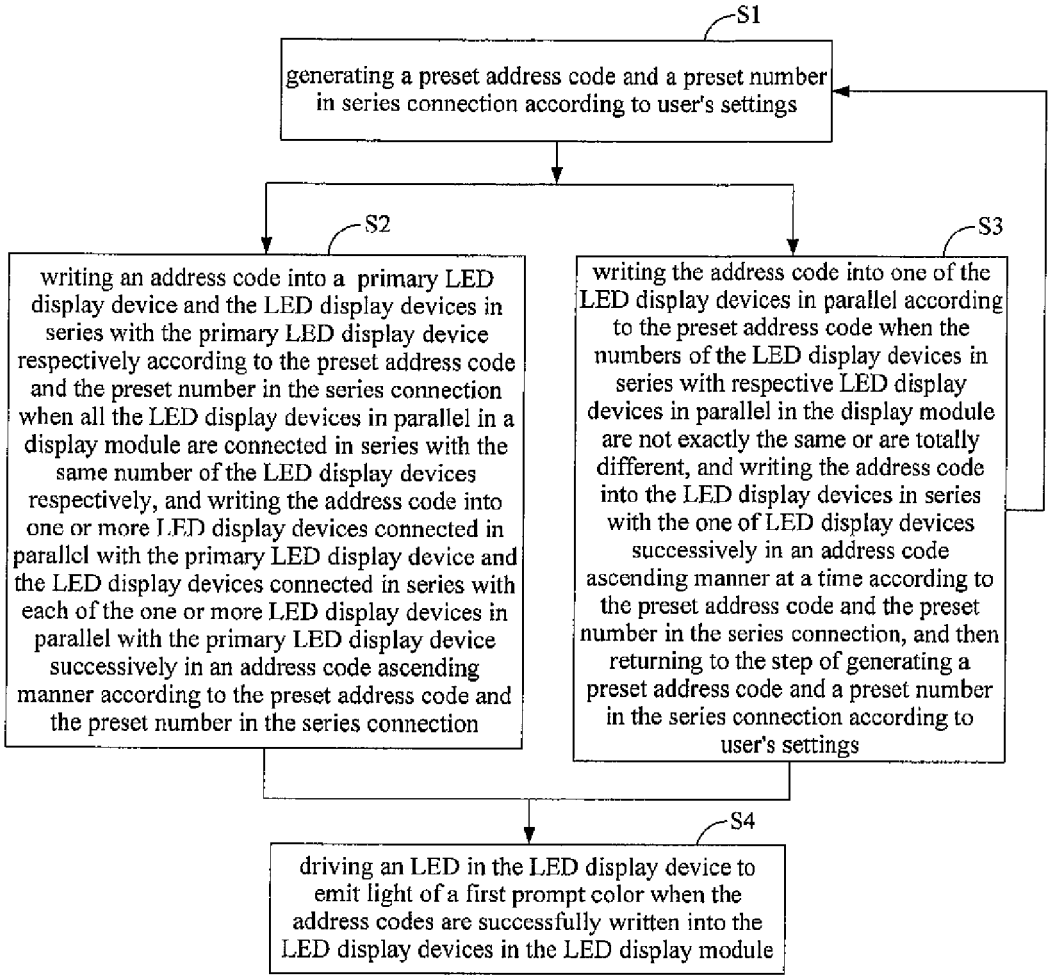
FIG. 1 is a flow chart of a method for writing address codes into LED display devices according to an embodiment of the present invention.

FIG. 1 illustrates a flow of a method for writing address codes into LED display devices according to the embodiment of the present invention. For ease of description, parts relevant to the embodiment of the present invention are only illustrated.

In step S1, a preset address code and a preset number in series connection are generated according to user's settings.

The preset address code is an address code of an LED display device into which the address code is primarily written, the LED display device is one of all LED display devices in parallel, therefore, the preset address code is also referred to as an initial address code, the preset number in the series connection is the number of the LED display devices connected in series with each of the LED display devices in parallel.

In step S2, when all the LED display devices in parallel in a display module are connected in series with the same number of LED display devices respectively, the address code is written into the primary LED display device and the LED display devices in series with the primary LED display device respectively according to the preset address code and the preset number in the series connection, and then the address code is written into one or more LED display devices connected in parallel with the primary LED display device and the LED display devices connected in series with each of the one or more LED display devices in parallel with the primary LED display device successively in an address code ascending manner according to the preset address code and the preset number in the series connection.

With regard to step S2, actually, it can be understood that, the preset address code is acted as the address code of the primary LED display device, then the address code is written into the LED display devices in series with the primary LED display device successively in an address code ascending manner according to the preset number in the series connection, the address code of the following LED display device connected in parallel with the primary LED display device is obtained by increasing the address code of the previous LED display device, i.e. the LED display device which is connected in series with the primary LED display device and is the last one of the LED display devices in the same power supply branch.

In step S3, when the numbers of the LED display devices in series with respective LED display devices in parallel in the display module are not exactly the same or are totally different, the address code is written into one of LED display devices in parallel according to the preset address code, then the address code is written into the LED display devices in series with the one of LED display devices successively in an address code ascending manner at a time according to the preset address code and the preset number, and then return to step S1.

With regard to step S3, since the numbers of LED display devices in each power supply branch are not exactly the same or are totally different, it is impossible to automatically complete the writing of address codes into all the LED display devices by setting the address code and the number at a time. At a time, the address codes only can be written into one of the LED display devices in parallel and the LED display devices connected in series with the one of LED display devices in parallel, i.e. manual coding. In other words, during the writing of address codes every time, operators need to set the address code and the number in the series connection, then beginning from the primary LED display device in each power supply branch, i.e. one of the LED display devices in parallel, the address code is written into the LED display devices connected in series with the primary LED display device successively in an address code ascending manner according to the preset number. The efficiency of the writing address codes is not better than that of step S2; however, address codes still can be written into all the serial LED display devices in the same power supply branch at a time. Therefore, the efficiency also can be improved to some extent.

In step S4, when the address codes are successfully written into the LED display devices in the LED display module, an LED in the LED display device is driven to emit light of a first prompt color.

When the address codes are not successfully written into the LED display devices in the LED display module, the LED in the LED display device is driven to emit light of a second prompt color or controlled to emit no light.

The first color and the second color are different, for example, the first color is red, and the second is green.

Figure 2:
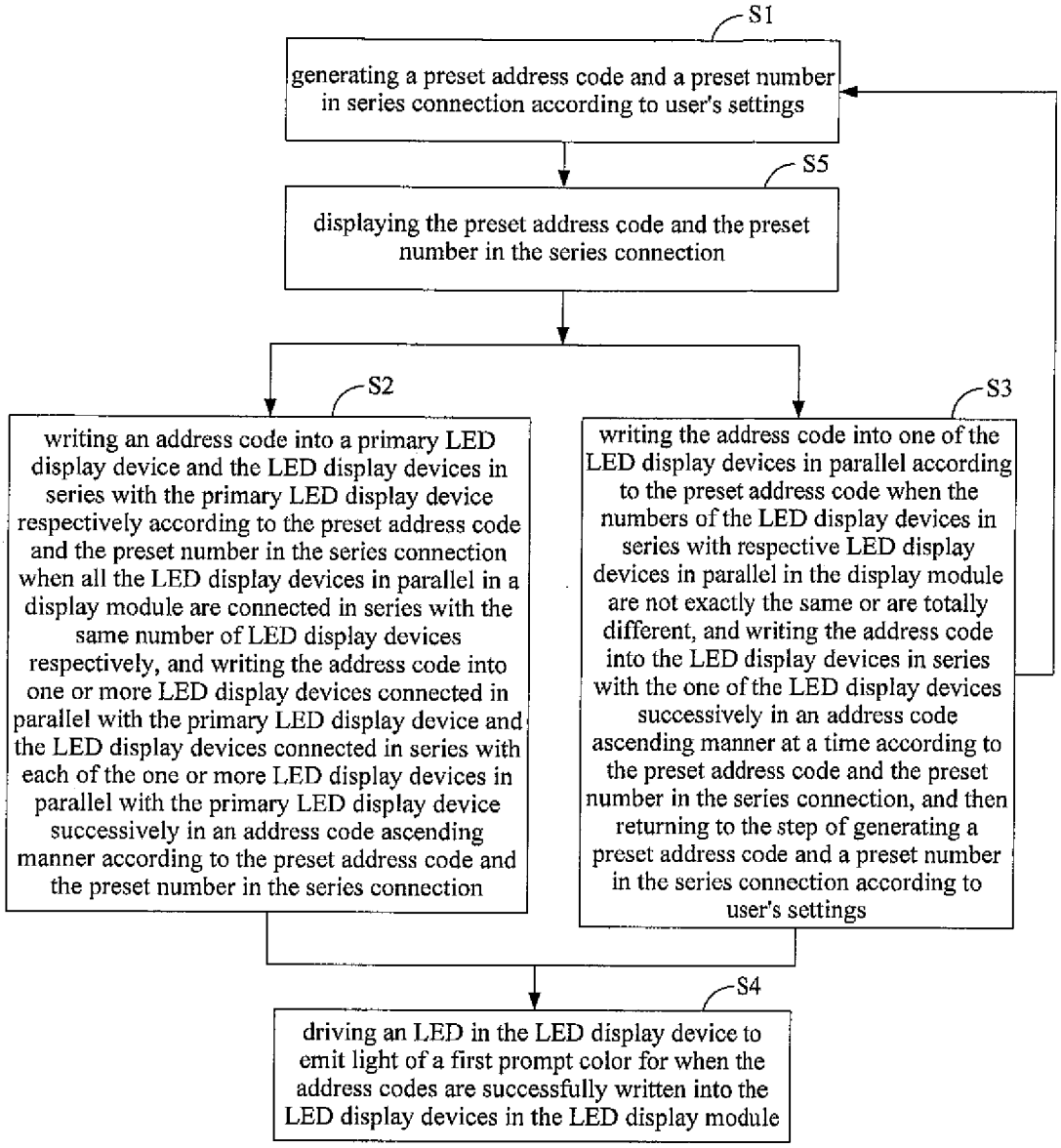
FIG. 2 is a flow chart of a method for writing address codes into LED display devices according to another embodiment of the present invention.

According to another embodiment of the present invention, as shown in FIG. 2, after step S1, the method further includes the following step:

Step S5, the preset address code and the preset number in the series connection are displayed.

Thus the preset address code of the LED display device and the preset number in the series connection can be learned clearly.

Exemplarily, the following will describe the method for writing address codes into LED display devices in detail.

Figure 3:
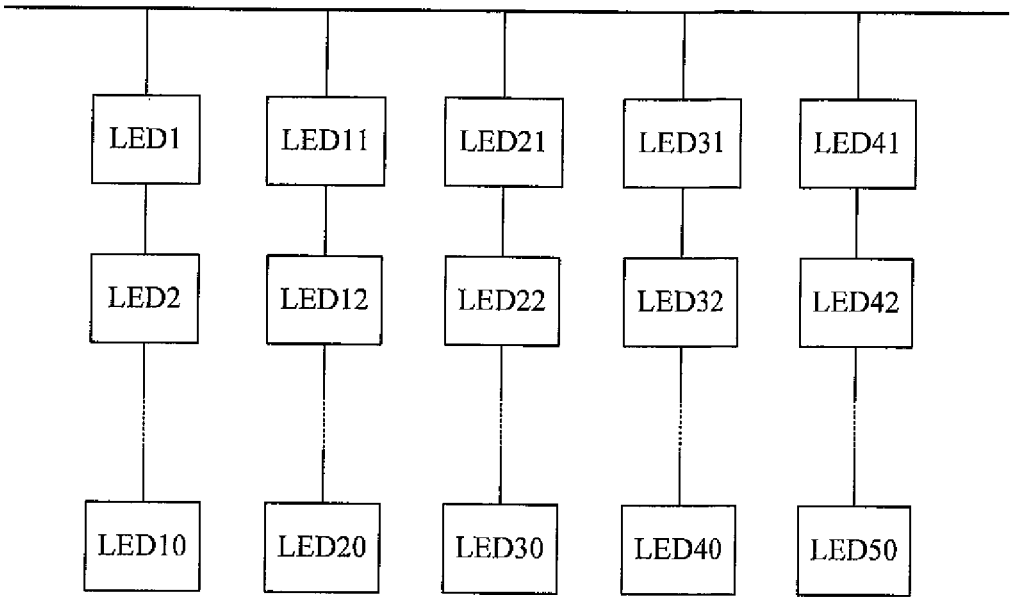
FIG. 3 is a schematic diagram of an LED display module related to a method for writing address codes into LED display devices according to an embodiment of the present invention.

(1) For the case of step S2, as shown in FIG. 3, if there are fifty LED display devices in the LED display module, five LED display devices are connected in parallel, the remaining forty-five LED display devices are divided into five groups which are connected in series with the five LED display devices respectively, i.e. there are ten LED display devices at a power supply branch and five branches in total. The fifty LED display devices are named after LED1 to LED50. LED1, LED11, LED21, LED31 and LED41 are connected in parallel to the same signal bus, LED1 to LED10 are located in a first power supply branch, LED11 to LED20 are located in a second power supply branch, LED21 to LED30 are located in a third power supply branch, LED31 to LED40 are located at a fourth power supply branch, LED41 to LED50 are located at a fifth power supply branch. The address code of LED1 and the number of serial LED display devices in every the power supply branch except for LED1, LED11, LED21, LED31 and LED41 are preset by an operator, then the address code is written into LED1 to LED50 successively in an address code ascending manner. As examples, the address code can be a binary code, the address code of LED1 is 00000001, thus the address code of LED2 is 00000010, and then the address code is written into LED display devices in each power supply branch successively in an address code ascending manner according to the preset number in the series connection until LED50, the address code of LED50 is 00110010. Therefore, address codes can be automatically written into all the LED display devices in the LED display module at a time.

Figure 4:
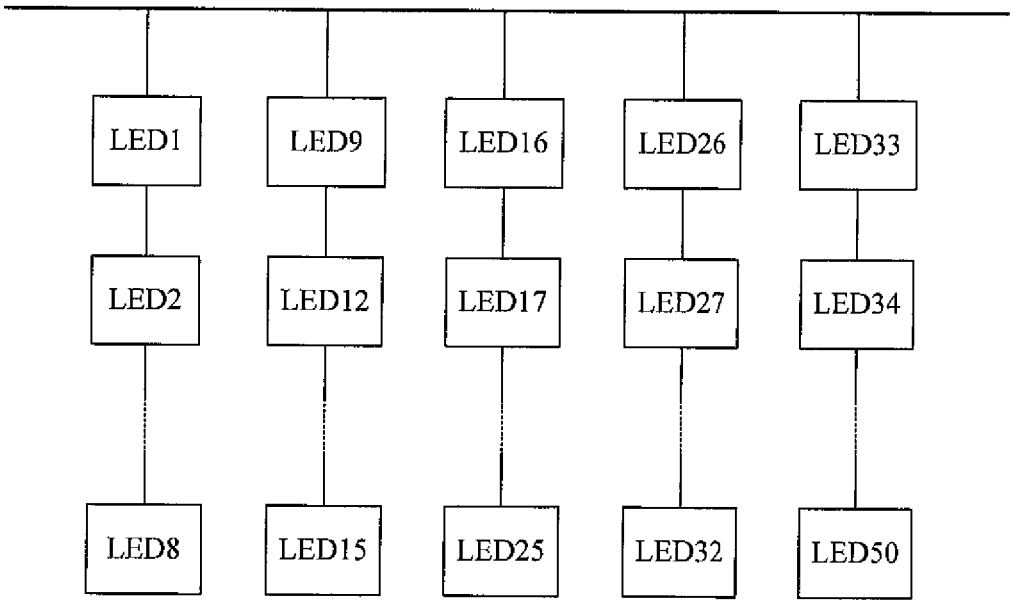
FIG. 4 is another schematic diagram of an LED display module related to a method for writing address codes into LED display devices according to an embodiment of the present invention.

(2) For the case of step S3, as shown in FIG. 4, if there are fifty LED display devices in the LED display module, LED1 to LED8 are located in a first power supply branch, LED9 to LED15 are located in a second power supply branch, LED16 to LED25 are located in a third power supply branch, LED26 to LED32 are located in a fourth power supply branch, LED33 to LED50 are located in a fifth power supply branch. Since the numbers of the LED display devices located in different power supply branches are different, the operator needs to set the address codes of LED1, LED9, LED16, LED26 and LED33 before writing of address codes, and to set the number of remaining serial LED display devices in each power supply branch. For example, if the address code of LED1 is set as 00000001 and the number of the first branch is seven, the address codes from 00000001 to 00001000 are only written into LED1 to LED8 respectively at the first time, then if the address code of LED9 is set as 00001010 and the number of the second branch is six, the address codes from 00001010 to 00010000 are written into LED9 to LED15 respectively at the second time, similarly, the address codes are written into the third branch, fourth branch and fifth branch by several times.

Figure 5:
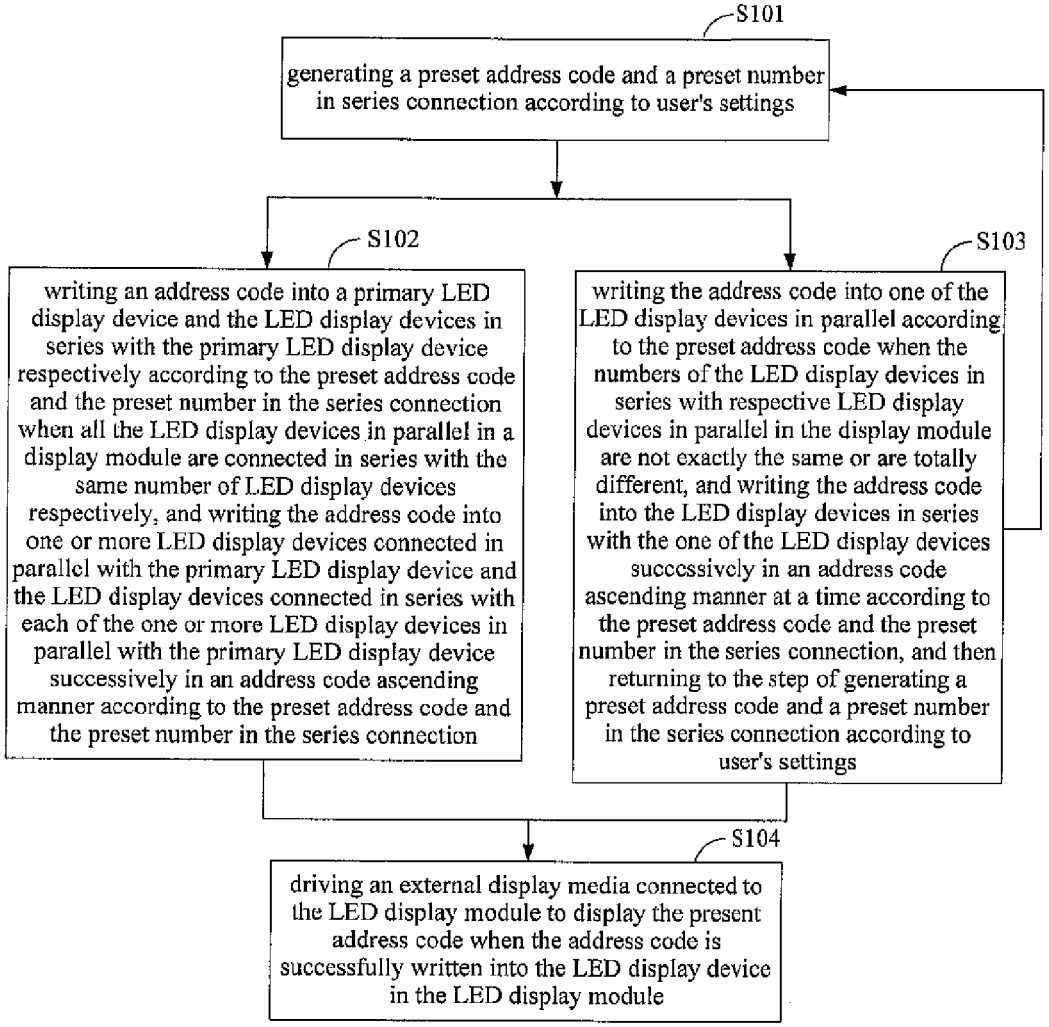
FIG. 5 is a flow chart of a method for writing address codes into LED display devices according to another embodiment of the present invention.

FIG. 5 illustrates a flow of a method for writing address codes into LED display devices according to another embodiment of the present invention. For ease of description, parts relevant to the embodiment of the present invention are only illustrated.

In the embodiment, steps S101, S102 and S103 are the same with steps S1, S2 and S3 of FIG. 1 respectively; it will not be explained here. The method further includes the following steps according to the embodiment of the present invention.

In step S104, when the address code is successfully written into the LED display device in the LED display module, an external display media connected to the LED display module is driven to display the present address code.

Figure 6:
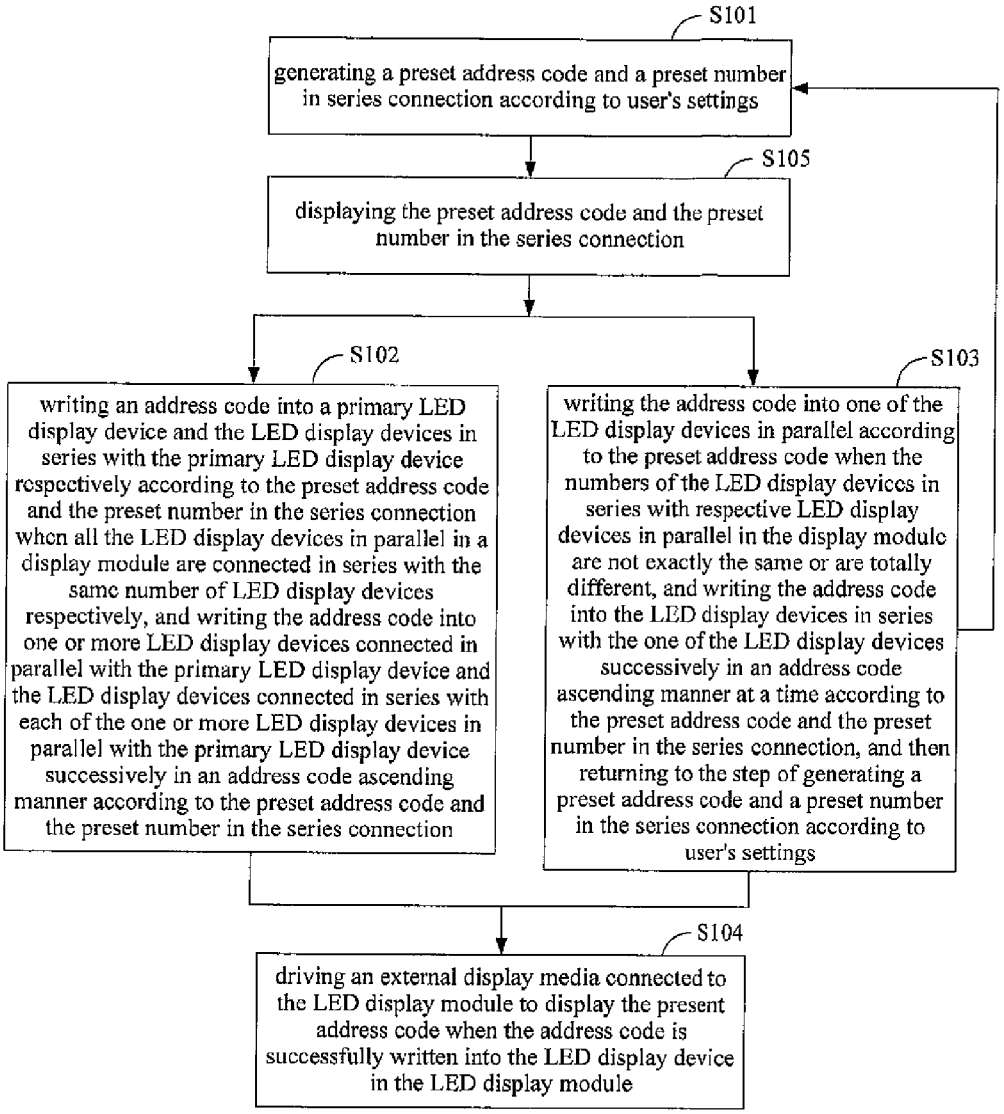
FIG. 6 is a flow chart of a method for writing address codes into LED display devices according to another embodiment of the present invention.

According to another embodiment of the present invention, as shown in FIG. 6, after step S101, the method further includes the following step:

Step S105, the preset address code and the preset number in the series connection are displayed.

Figure 7:
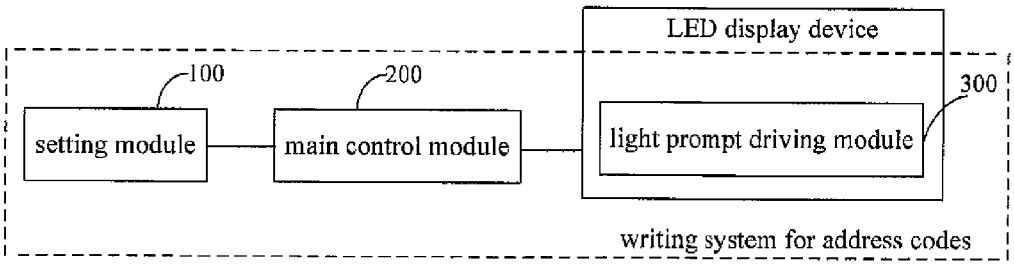
FIG. 7 is a schematic structure diagram of a system for writing address codes into LED display devices according to an embodiment of the present invention.

FIG. 7 illustrates structure of modules of a system for writing address codes into LED display devices according to the embodiment of the present invention. For ease of description, parts relevant to the embodiment of the present invention are only illustrated.

The system for writing address codes into LED display devices according to the embodiment of the present invention includes a setting module 100 and a main control module 200.

The setting module 100 is configured to generate a preset address code and a preset number in series connection according to user's settings.

The main control module 200 is configured to write an address code into an primary LED display device and the LED display devices in series with the primary LED display device respectively according to the preset address code and the preset number in the series connection when all the LED display devices in parallel in a display module are connected in series with the same number of LED display devices respectively, and write the address code into one or more LED display devices connected in parallel with the primary LED display device and the LED display devices connected in series with each of the one or more LED display devices in parallel with the primary LED display device successively in an address code ascending manner according to the preset address code and the preset number in the series connection.

when the numbers of the LED display devices in series with respective LED display devices in parallel in the display module are not exactly the same or are totally different, the main control module 200 writes the address code into one of LED display devices in parallel according to the preset address code, and writes the address code into the LED display devices in series with the one of LED display devices successively in an address code ascending manner at a time according to the preset address code and the preset number in the series connection, and then returns to the setting module 100.

The writing system for address codes further includes:

a light prompt driving module 300 disposed in the LED display device, configured to drive an LED in the LED display device to emit light of a first prompt color when the address codes are successfully written into the LED display devices in the LED display module.

When the address codes are not successfully written into the LED display devices in the LED display module, the light prompt driving module 300 drives the LED in the LED display device to emit light of a second prompt color or controls the LED in the LED display device to emit no light.

In practical applications, the above-mentioned system can be implemented in particular as follows.

The setting module 100 can be an encode circuit with a multi-bit dial switch and a key, the multi-bit dial switch and the key can be operated to set the preset address code and the preset number in the series connection.

The main control module 200 can be a control circuit having a microprocessor and a converting circuit of output signals. When all the LED display devices in parallel in the display module are connected in series with the same number of the LED display devices, the main control module 200 automatically writes the address code into the LED display devices from the primary LED display device to the last LED display device successively in an address code ascending manner at a time according to the address code and the number in the series connection preset by the setting module 100. When the numbers of LED display devices in series with respective LED display devices in parallel in the display module are not exactly the same or are totally different, after the address code and the number are set by several times by the setting module 100, the main control module 200 only writes the address code into one of the LED display devices in parallel and the LED display devices connected in series with the one of LED display devices at a time. The converting circuit of output signals is mainly configured to convert writing signals output by a microcontroller to RS485 signals and TTL signals with voltage from 5V to 12V, and output the RS485 signals and TTL signals to the LED display device so as to complete the writing of address code.

The light prompt driving module 300 can be a drive circuit used for driving the LED to emit light. When the address codes are successfully written into the LED display devices, the LED in the LED display device is driven to emit light of the first prompt color such as green. When the address codes are not successfully written into the LED display devices, the LED in the LED display device is driven to emit light of the second prompt color such as red or controlled to emit no light.

It is to be noted that, when all switches in the multi-bit dial switch are switched to default states or grounded, i.e. all the LED display devices in parallel in the LED display module are not connected in series with any LED display devices, it is not necessary to preset the number in the series connection.

Figure 8:
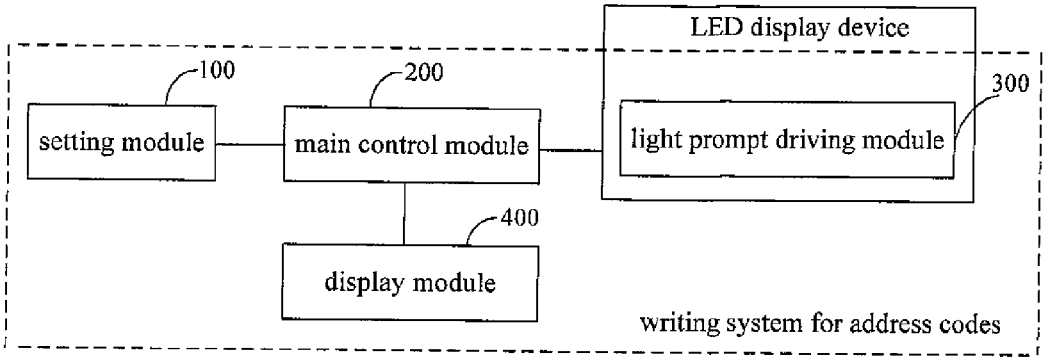
FIG. 8 is a schematic structure diagram of a system for writing address codes into LED display devices according to another embodiment of the present invention.

In order to clearly learn the preset address code of the LED display device and the preset number in the series connection, as shown in FIG. 8, the system according to another embodiment of the present invention further includes:

A display module 400, configured to display the preset address code and the preset number in the series connection.

In practical applications, the above-mentioned system including the display module 400 can be implemented in particular as follows.

The setting module 100 can be an encode circuit having a plurality of keys, the plurality of keys can be operated to set the preset address code and the preset number in the series connection. According to this implementation different from relative to the above multi-bit dial switch, a plurality of keystrokes are needed to perform addition or subtraction on address codes and the number in the series connection. The setting can be completed; however, it is more complex than the implementation using the multi-bit dial switch.

The main control module 200 can be a control circuit having a microprocessor and a converting circuit of output signals. When all the LED display devices in parallel in the display module are connected in series with the same number of LED display devices respectively, the main control module 200 automatically writes the address code into the LED display devices from the primary LED display device to the last LED display device successively in an address code ascending manner at a time according to the address code and the number in the series connection preset by the setting module 100. When the numbers of LED display device in series with respective LED display devices in parallel in the display module are not exactly the same or are totally different, after the address code and the number are set by several times by the setting module 100, the main control module 200 only writes the address code into one of the LED display devices in parallel and the LED display devices in series with the one of LED display device at a time. The converting circuit of output signals is mainly configured to convert writing signals output by the microcontroller to the RS485 signals and TTL signals with voltage from 5V to 12V, and output the RS485 signals and TTL signals to the LED display device so as to complete the writing of address codes.

The light prompt driving module 300 can be a drive circuit used for driving the LED to emit light. When the address codes are successfully written into the LED display devices, the light prompt driving module 300 drives the LED in the LED display device to emit light of the first prompt color, such as green. When the address codes are not successfully written into the LED display devices, the light prompt driving module 300 drives the LED in the LED display device to emit light of the second prompt color such as red for or controls the LED in the LED display device to emit no light.

The display module 400 can be an LCD display or an LED display.

The implementation of the writing system of the address code according to the present invention are not limited to the above-mentioned implementations, in other implementations, a multi-bit dial switch can be used together with the LCD display or the LED display to display the address code and the number.

Figure 9:
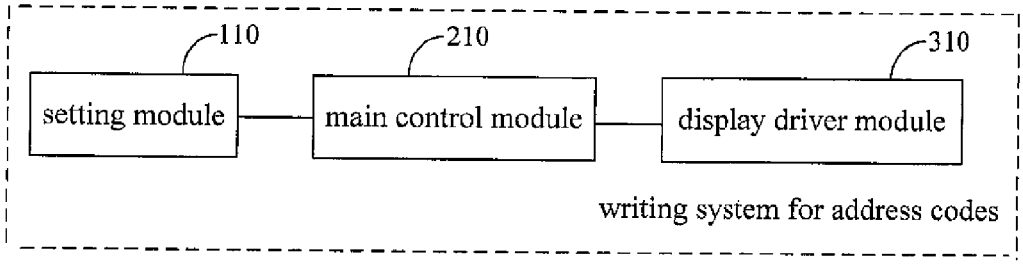
FIG. 9 is a schematic structure diagram of a system for writing address codes into LED display devices according to another embodiment of the present invention.

FIG. 9 illustrates structure of modules of a system for writing address codes into LED display devices according to another embodiment of the present invention. For ease of description, parts relevant to the embodiment of the present invention are only illustrated.

A system for writing address codes into LED display devices according to the embodiment of the present invention includes a setting module 110 and a main control module 210, the setting module 110 and the main control module 210 are the same with the setting module 100 and the main control module 200 respectively, which are not explained here. The writing system of the address code according to the embodiment of the present invention further includes:

A display driver module 310, configured to drive an external display media connected to the LED display module to display the present address code when the address code is successfully written into the LED display device in the LED display module.

In practical applications, the display driver module 310 can be a drive circuit of the external display media, and is used to drive the display media, such as the LED display, the LCD display or a display array comprised by a plurality of LEDs, to display the address code which has been successfully written into the LED display device.

Figure 10:
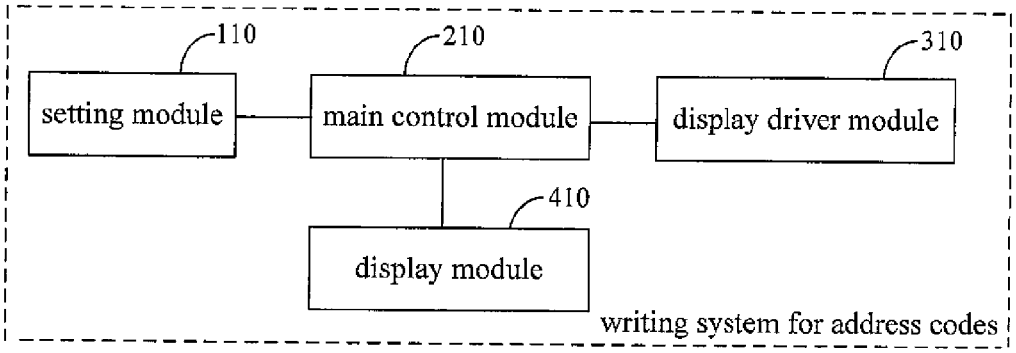
FIG. 10 is a schematic structure diagram of a system for writing address codes into LED display devices according to another embodiment of the present invention.

According to another embodiment of the present invention, as shown in FIG. 10, the writing system of the address codes further includes:

a display module 410, configured to display the preset address code and the preset number in the series connection.

According to the embodiments of the present invention, when all the LED display devices in parallel in the display module are connected in series with the same number of LED display devices, the address code is written into the primary LED display device and the LED display devices in series with the primary LED display device respectively according to the preset address code and the preset number in the series connection, and the address code is written into one or more LED display devices connected in parallel with the primary LED display device and the LED display devices connected in series with each of the one or more LED display devices in parallel with the primary LED display device successively in an address code ascending manner. Thus address codes are written into the LED display devices at a time, it is not necessary to write address codes into the LED display devices one by one, therefore, the efficiency of writing codes is improved.

What described above are only preferred embodiments of the present disclosure but are not intended to limit the scope of the present disclosure, any modifications, equivalent replacements and improvements etc. made within the spirit and principle of the present invention, should be included in the protection scope of the present invention.

The invention claimed is:

1. A method for writing address codes into LED display devices comprising the steps of:

generating a preset address code and a preset number in series connection according to user's settings; and writing an address code into a primary LED display device and the LED display devices in series with the primary LED display device respectively according to the preset address code and the preset number in the series connection when all the LED display devices in parallel in a display module are connected in series with the same number of the LED display devices respectively, and writing the address code into one or more LED display devices connected in parallel with the primary LED display device and the LED display devices connected in series with each of the one or more LED display devices in parallel with the primary LED display device successively in an address code ascending manner according to the preset address code and the preset number in the series connection;

wherein, writing the address code into one or more LED display devices connected in parallel with the primary LED display device and the LED display devices connected in series with each of the one or more LED display devices in parallel with the primary LED display device successively in an address code ascending manner according to the preset address code and the preset number in the series connection specifically comprises:

obtaining an address code of a following LED display device connected in parallel with the primary LED display device by increasing the address code of a previous LED display device that is connected in series with the primary LED device and is the last one of the LED display device in the same power supply branch.

2. The method according to claim 1, wherein the method further comprises:

writing the address code into a primary LED display device according to the preset address code when the numbers of LED display devices in series with respective LED display devices in parallel in the display module are not exactly the same or are totally different, and writing the address code into the LED display devices in series with the primary LED display device successively in an address code ascending manner at a time according to the preset address code and the preset number in the series connection, and then returning to the step of generating a preset address code and a preset number in the series connection according to user's settings.

3. The method according to claim 2, wherein the method further comprises:

driving an LED in the LED display device to emit light of a first prompt color when the address codes are successfully written into the LED display devices in the LED display module, or driving the LED in the LED display device to emit light of a second prompt color or controlling the LED in the LED display device to emit no light when the address codes are not successfully written into the LED display devices in the LED display module.

4. The method according to claim 2, wherein the method further comprises:

driving an external display media connected to the LED display module to display the present address code when the address code is successfully written into the LED display device in the LED display module.

5. The method according to claim 1, wherein after the step of generating a preset address code and a preset number in the series connection according to user's settings, the method further comprises:

displaying the preset address code and the preset number in the series connection.

6. A system for writing address codes into LED display devices comprising:

a setting module, configured to generate a preset address code and a preset number in series connection according to user's settings; and a main control module configured to write an address code into a primary LED display device and the LED display devices in series with the primary LED display device respectively according to the preset address code and the preset number in the series connection when all the LED display devices in parallel in a display module are connected in series with the same number of the LED display devices respectively, and write the address code into one or more LED display devices connected in parallel with the primary LED display device and the LED display devices connected in series with each of the one or more LED display devices in parallel with the primary LED display device successively in an address code ascending manner according to the preset address code and the preset number in the series connection;

wherein an address code of a following LED display device connected in parallel with the primary LED display device is obtained by increasing the address code of a previous LED display device that is connected in series with the primary LED device and is the last one of the LED display device in the same power supply branch.

7. The system according to claim 6, wherein when the numbers of the LED display devices in series with respective LED display devices in parallel in the display module are not exactly the same or are totally different, the main control module writes the address code into a primary LED display device according to the preset address code, and writes the address code into the LED display devices in series with the primary LED display device successively in an address code ascending manner at a time according to the preset address code and the preset number in the series connection, and then returns to the setting module.

8. The system according to claim 7, wherein the system further comprises:

a light prompt driving module disposed in the LED display device configured to drive an LED in the LED display device to emit light of a first prompt color when the address codes are successfully written into the LED display devices in the LED display module, or drive the LED in the LED display device to emit light of a second prompt color or control the LED in the LED display device to emit no light when the address codes are not successfully written into the LED display devices in the LED display module.

9. The system according to claim 7, wherein the system further comprises:

a display driver module configured to an external display media connected to the LED display module to display the present address code when the address code is successfully written into the LED display device in the LED display module.

10. The system according to claim 6, wherein the system further comprises:

a display module configured to display the preset address code and the preset number in the series connection.

11. The method according to claim 2, wherein before writing of the address codes when the numbers of the LED display devices in series with respective LED display devices in parallel in the display module are not exactly the same or are totally different, the method further comprises:

presetting the address code of the primary LED device and the number of the LED devices in series connection with the primary LED device in each power supply branch manually.

12. The system according to claim 6, wherein the setting module can be an encode circuit having a plurality of keys, the plurality of keys can be operated to set the preset address code and the preset number in the series connection.

* * * * *